US005615800A

United States Patent [19]

Meyers

[11] Patent Number: 5,615,800

[45] Date of Patent: Apr. 1, 1997

[54] INTEGRATED BUSINESS CARD DISPENSER

[76] Inventor: Michael C. Meyers, 4360 Muirwood Dr., Pleasonton, Calif. 94588

[21] Appl. No.: 422,125

[22] Filed: Apr. 13, 1995

[51] Int. Cl.[6] ..... B65H 1/08

[52] U.S. Cl. ..... 221/232; 221/259

[58] Field of Search ..... 221/210, 232, 221/259, 272, 277, 258, 274, 268, 262

[56] References Cited

U.S. PATENT DOCUMENTS

| | | | |
|---|---|---|---|
| 3,042,172 | 7/1962 | Bowlby | 221/210 |
| 4,401,233 | 8/1983 | Frey | 221/210 |
| 4,792,058 | 12/1988 | Parker | 221/232 |
| 4,887,739 | 12/1989 | Parker | 221/232 |
| 5,083,391 | 1/1992 | Kyler | 40/642 |
| 5,092,062 | 3/1992 | Palka | 40/124 |
| 5,235,519 | 8/1993 | Miura | 364/479 |
| 5,322,190 | 6/1994 | Bartley | 221/259 |

*Primary Examiner*—Kenneth Noland
*Attorney, Agent, or Firm*—Ray K. Shahani, Esq.

[57] ABSTRACT

An integrated business card and information dispenser device, for dispensing one or more pieces of information or business cards with each stroke of the dispensing lever, which can be mounted permanently or temporarily using a variety of mounting means, the device having a business card and information storage area and a dispensing means, the device also having a secured, locking article storage area, the device being waterproof and having various indicia display surfaces.

9 Claims, 2 Drawing Sheets

INTEGRATED BUSINESS CARD DISPENSER

FIELD OF THE INVENTION

This invention relates to business card and information dispensers and other types of information distribution systems, and more particularly to an integrated business card and information dispenser device, for dispensing one or more pieces of information or business cards with each stroke of the dispensing lever, which can be mounted permanently or temporarily using a variety of various mounting means, the device having a business card and information storage area and a dispensing means, the device also having a secured, locking article storage area, the device being waterproof and having various indicia display surfaces.

BACKGROUND OF THE INVENTION

A variety of various types of devices and systems have been described in the prior art related to dispensers of various types. Vending machines have been created to dispense a great number of different items, such as canned drink, personal hygiene products, music and video tapes, stamps and the like. Typical means for dispensing flat articles from vending machines is to load the device with a stack of articles on a spring loaded support and provide release or pusher arms, cams and cam followers or circular cam wheels or bell cranks coupled using crank pins, etc.

U.S. Pat. No. 4,792,058 issued Dec. 20, 1988 to Parker and U.S. Pat. No. 4,887,739 also issued Dec. 19, 1989 to Parker both teach business card dispensers. These small, pocket sized devices are similar to each other in appearance and function, and comprise a casing being generally closed on the top and bottom and sides, the casing having an area for storing a stack of business cards, a card support base resiliently urged so as to align the cards relative to a discharge slot or opening in one end of the casing, and an ejector mechanism, operable through a side wall, which interacts with the card support plate to dispense cards manually. These devices have certain drawbacks which make them less than desirable for various purposes. For example, the devices are not intended to be mounted either temporarily or permanently onto a vehicle or structure. Nor are they waterproof. Another drawback is that there is no storage area for placing other peoples cards or notes, a very useful feature of the present invention.

U.S. Pat. No. 5,083,391 issued Jan. 28, 1992 to Kyler teaches a display and dispensing apparatus. The device is intended to serve as both an advertising medium, for business cards and the like, and as a means to dispense certain articles needed in the particular business setting, such as salt and pepper and sugar, etc. The device comprises a multi-sided, substantially upright enclosure with side walls for placing or mounting business cards. A central section or peripherally mounted section can be used to store and dispense other useful articles. This device suffers from many of the same drawbacks as do other devices of the prior art, namely, it is not waterproof or weatherproof, it is not intended to be mounted on a structure either permanently or temporarily if portable, nor is there a securable storage area for others to deposit or leave other articles or other business cards or messages.

U.S. Pat. No. 5,092,062 issued Mar. 3, 1992 to Palka teaches a display device. This device can be used to display small placards or business cards or other information brochures, articles, etc. The device comprises a plurality of open topped, card-receiving pockets arranged on the front face of a main plate-like body panel of plastic or other material. The card-receiving pockets are integrally formed with the main plate and have substantially horizontal and vertical lips with inturned and upturned ledges for supporting a stack of cards and permitting the cards to be grasped by the fingers of a person and removed therefrom. The device provides no protection to the cards from inclement environments and would therefore be completely useless mounted on the outside of a structure, exposed to the natural or other environment, where wind and rain could damage the cards or other information being distributed. Nor is there any security provided against misappropriation of cards or messages left on the device and intended for a particular individual or entity.

U.S. Pat. No. 5,235,519 issued Aug. 10, 1993 to Miura teaches a card vending machine. These types of devices have existed for years, commonly located in train stations, airports, business centers, etc. This device is money activated, electronically operated and computer controlled. The vending machine comprises a computer screen and keypad, input information being viewable on the computer screen as the user operates the device. When a user inserts a predetermined amount of money, the computer program prompts the user to input various information at various times, requesting information on card style, size, printing fonts and identifying information such as name, address, etc. The input identifying information is then automatically printed onto a set number of cards and the custom business cards are dispensed to the user. This device is large, bulky, requires electricity, is prone to vandalism and actually produces business cards. The device does not serve the purpose of providing a business card dispenser and information storage and retrieval center which can be portable and/or easily mountable on various structures, such as a front porch of a home or business, on a car or truck or other vehicle, nor is there a information storage means, other than that used to store information to be printed onto business cards. It is not truly a message center as it the present invention.

It is therefore an object of this invention to overcome the above cited problems with the existing technology, namely to provide a device which both stores and dispenses business cards or other articles, which can be mounted temporarily or permanently, which is waterproof and weatherproof, and which can be used to store messages or other articles securely by having a lockable article storage area.

SUMMARY OF THE INVENTION

The present invention is a system for providing the public or other individuals access to a business card or other product or service information. Business cards are commonly used, even for notes or other memoranda. The invention can be used to dispense real estate information, business information, etc. The device could be used for a collection unit for mail, deliveries or messages in general. The invention is intended to be placed outside of a business, home, or other informational kiosks, where, for example, a number of these devices are assembled and mounted in tandem or other cooperation. The weatherproof construction allows for drainage and safe and dry storage of literature for distribution as well as items stored within the device.

The integrated business card and information dispenser is for storing a stack of flat articles such as business cards, promotional literature and other information, for dispensing the articles, and for securely receiving deposits and deliveries. The device comprises a housing, the housing having a top portion, a front face and a plurality of side portions, with one of the side portions having a dispensing slot extending horizontally across the portion. The dispensing slot has an aperture of a predetermined dimension such that a predetermined number of articles, whether it be one or two or several at a time, are dispensed from the device. A lower internal article storage section is accessible via a deposit window which allows articles to be deposited into the lower internal article storage section. An upper article storage and dispensing section is divided from the lower section by a central cross member. A spring or some other type of biasing means is attached to the lower surface of a floating platform for supporting the articles to be dispensed, the biasing means urging the floating platform upward, thus urging the stack of articles against the upper cross member. A slider with a lower friction surface is disposed between the upper cross member and the stack of articles. A dispensing lever extends through the front face of the housing for manual or mechanical operation, and is connected to the slider by a linking element and a pusher element. The position of the lever determines the lateral position of the slider. Thus, as the lever is operated to effect a transverse motion of the slider, the friction surface of the slider acts upon the uppermost article of the stack of articles to be dispensed, and only that particular article is moved outward from the upper section through the dispensing slot.

In another preferred embodiment the housing bears a plurality of identifying and informational indicia. In another preferred embodiment the top section is sloped to one side to prevent accumulation of rain, snow or other debris on the front face and to drain water away from the dispensing slot. In another preferred embodiment the device is weatherproof. In another preferred embodiment the biasing means is a spring.

In another preferred embodiment the device further comprises a mounting means, which could be nails, bolts, screws, magnets, fibers, straps, clamps, adhesives or adhesive-backed materials. The front face can be secured to the casing of the device with a security lock of any type, and the device could further comprise a marking device.

Numerous other advantages and features of the present invention will become readily apparent from the following detailed description of the invention and the embodiments thereof, from the claims and from the accompanying drawings in which the details of the invention are fully and completely disclosed as a part of this specification.

DETAILED DESCRIPTION OF THE INVENTION

Figure 1:
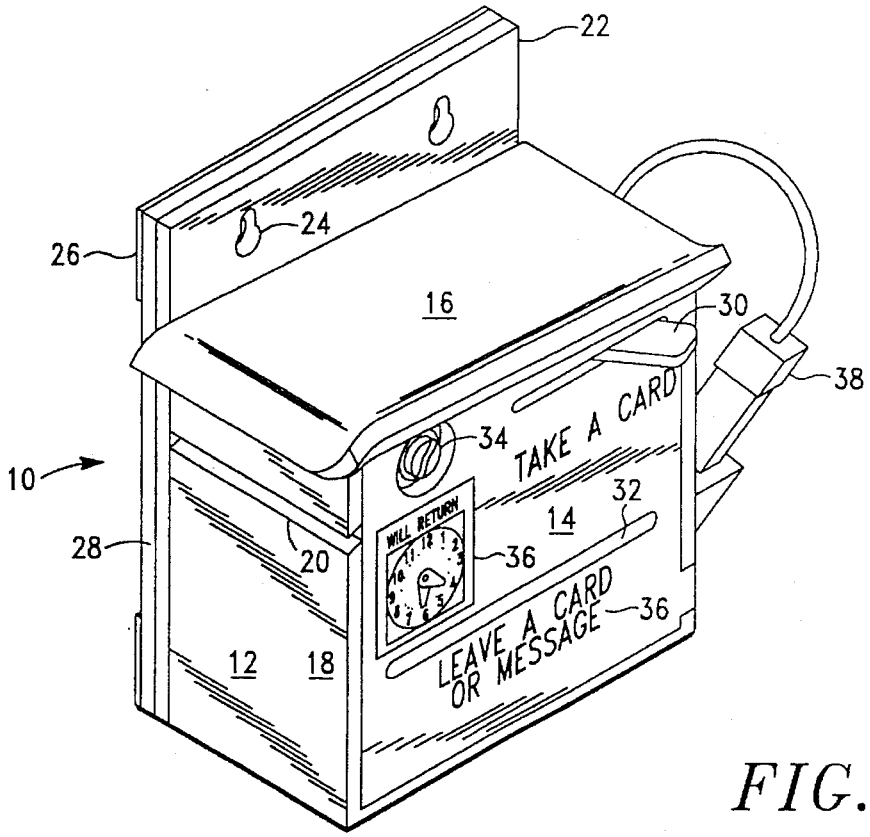
FIG. 1 is a left front top perspective view of an embodiment of the present invention.

FIG. 1 is a left front top perspective view of an embodiment of the present invention. The integrated business card and information dispenser 10 consists of a central housing, 12, the central housing having a front face 14, a top section 16, a side portion 18 with a dispensing slot 20, and a back portion 22. The system can be different sizes and shapes, as shown the device is especially useful for dispensing business cards in common use today. The housing could also be welded or molded or be integral to certain housing, business, garage, parking or other construction (for example, the device could be constructed or installed into a wall or vertical member). Any one or more of the front, back, side, top or bottom sections or any part thereof could be constructed out of a transparent or semitransparent material. This would allow the owner or operator of one of the inventions to visually check the supply level of business cards or other stacked articles inside the article storage and dispensing area as well as check the message storage area for messages or other deliveries.

The back portion can be equipped with a mounting means—as shown, a hole or pair of holes 24, adhesive-backed pads 26, or a section of magnetized material 28. Any of a variety of mounting means can be used or supplied with the device and would include straps or other forms of elastic materials like rubber bands or bungee cords, adhesives, etc. The device could also be mounted on a horizontal surface or suspended. The mounting means may also include, in a preferred embodiment, one or two internal screws attaching the invention to the structure or surface it is being mounted upon. This internal screw or screws, or other bolt, latch, couple, etc. would help prevent theft of the device. If at least one screw is mounted from the inside of the invention, for example through the central section such that when the front section or door is closed and locked, there will be no way to remove the mounted invention unless the front section or door is first opened, typically requiring a key or some security code.

The dispensing lever 30, shown in the non-dispensing position, and a deposit window 32, are shown on the front face but could be located in different positions within the system. The front face of the housing is locked or otherwise closed by a securing lock 34, or other security locking means, shown in the present figure as a key lock. The lock could also be of the combination-type, electronic, magnetic, or other dependable and effective security system which would prevent the unauthorized entry or tampering with the contents of the lower internal article storage section. Identifying and informational indicia 36 can be placed on any of the surfaces, as shown placed on the front face. This could include information such as an invitation to take a business card or other information from the dispenser, a message or symbol or clockface with movable hands to indicate when the occupant or other will be available, or an invitation to leave a business card or leave a message or other article by placing such through the deposit window. A marking device 38 can be attached to the system. This could be a pencil or pen, marker, or other specialized or custom type of marking or communicating device.

Figure 2:
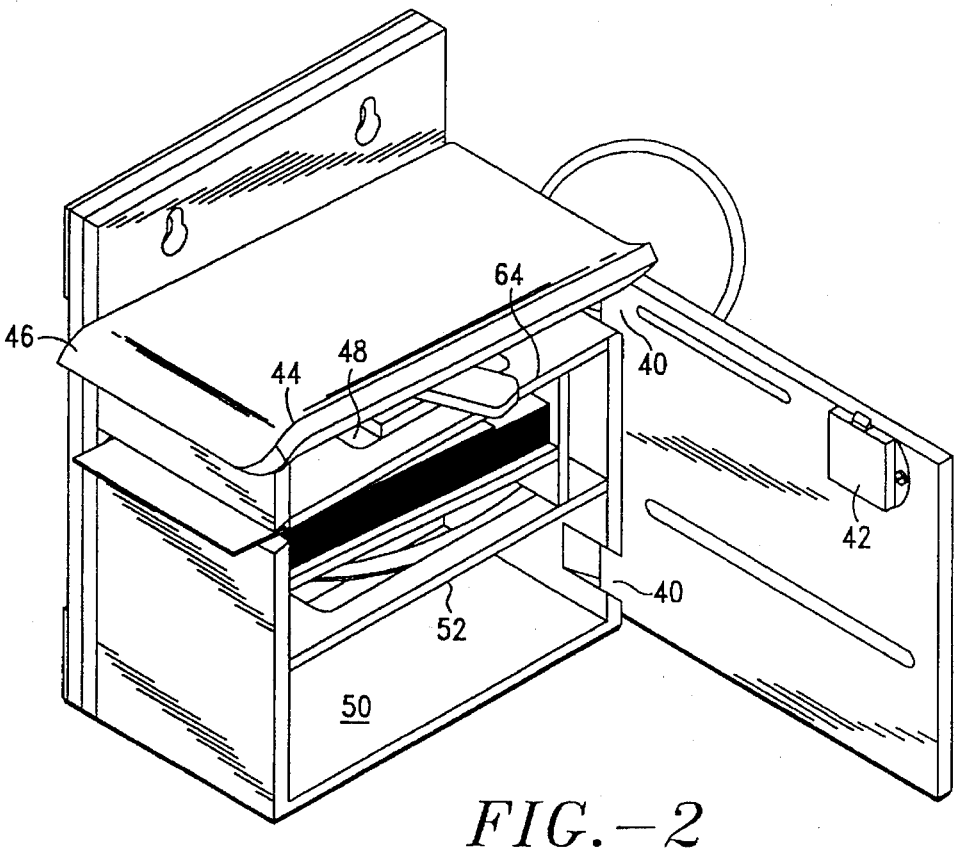
FIG. 2 is a left front top perspective view of an embodiment of the present invention in the dispensing position with the front section open.

FIG. 2 is a left front top perspective view of an embodiment of the present invention in the dispensing position with the front section open. Hinges 40 attach the front face of the housing to one side and the inside portion of the securing means 42 is shown. The top portion can have an upturned lip 44 and/or a sloping edge 46 on various sides to either separately or in conjunction with each other shield the front face and identifying and informational indicia thereon from rain and dust and snow, etc., as well as allow any accumulated water or debris to flow or be diverted to one side or another. Furthermore, all of the components of the device, especially those to be directly exposed to possibly adverse weather conditions, are manufactured using water and corrosion proof materials such as extruded, assembled or molded polymers or plastics, wood, stainless steel, other metals, alloys or composites, resins, or laminates or other combinations of the above. Also shown is a slider slot 48 or other guiding opening or structure to effect a guided motion of the slider and friction surface toward the dispensing slot.

The figure shows the internal view of the device in a perspective. In the lower part of the housing there is a lower article storage section 50 for allowing cards, notes, letters, mail, packages or other deliveries to be stored securely. The storage section would be accessible to any party with access through the securing means, such as business owners, tenants, guests, landlords, administrative and receptionist personnel, mail and delivery people, and others. A central cross section 52 separates the lower storage portion from the rest of the device.

Figure 3A:
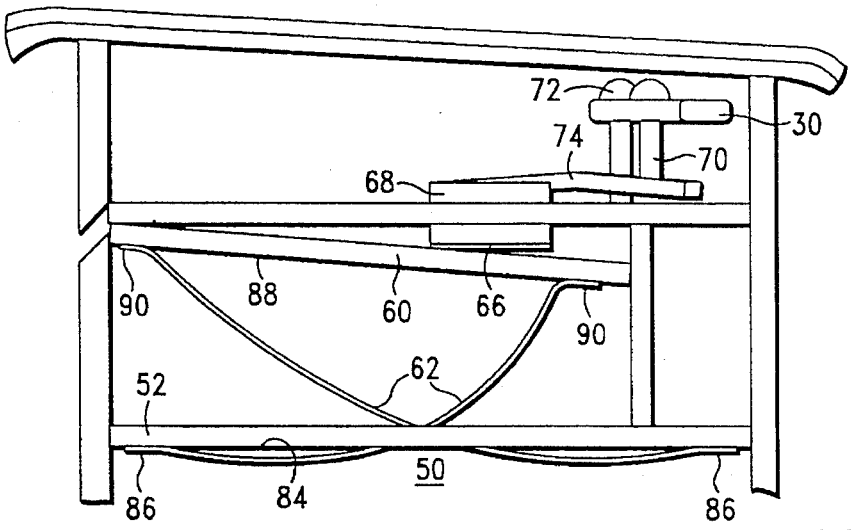
FIG. 3A is a front cross section view of an embodiment of the present invention in the unloaded position.

FIG. 3A is a front cross section view of an embodiment of the present invention in the unloaded position. The dispensing lever is in the non-dispense position. A floating platform 60 is supported by a pair of upwardly urging resilient members 62, in this case leaf springs. The platform is urged toward the upper cross member 64. A friction surface 66 on a slider element 68 slides in the slider slot to effect a guided motion of the slider and friction surface toward the dispensing slot. A linkage 70 connects the dispensing lever, pivoting at the rear 72, to a pusher element 74.

The embodiment shown depicts a pair of leaf springs attached at one end to the underside 84 of the central cross member at lower attachment points 86, and attached to the underside 88 of the floating platform at upper attachment points 90. It will be understood by those skilled in the art that these resilient members could be coil springs or even could be replaced by a section of foam or other resilient, spongy material.

Figure 3B:
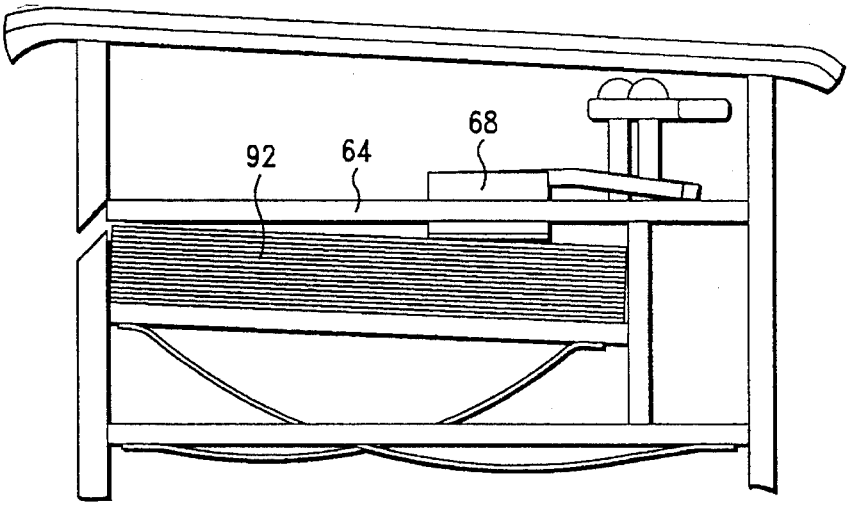
FIG. 3B is a front cross section view of an embodiment of the present invention in the loaded position.

FIG. 3B is a front cross section view of an embodiment of the present invention in the loaded position. A stack of business cards 92 or any other type of flat literature, brochures, promotional memos and fliers, or other is disposed between the upper cross member and the floating platform. The floating platform permits the stack of cards to be urged against the friction surface such that when the lever and slider assembly are at one end, the stack of cards is slightly tilted down on the right side.

Figure 3C:
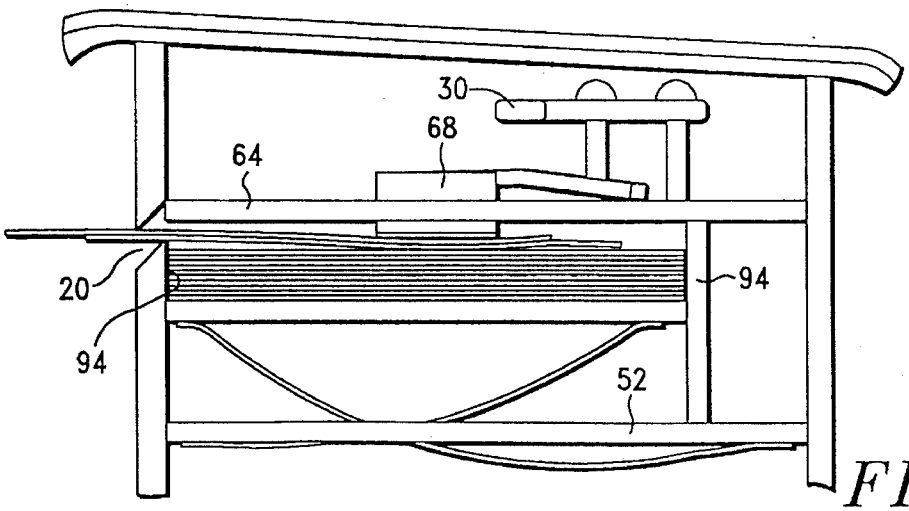
FIG. 3C is a front cross section view of an embodiment of the present invention in the dispensing position.

FIG. 3C is a front cross section view of an embodiment of the present invention in the dispensing position. In this view, the dispensing lever is moved to the left, the linkage having pushed the slider to the left along the lengthwise slot in the upper cross member. The dispensing slot can have any size opening, relative to the thickness of individual pieces of literature or cards being dispensed, and can be given a predetermined or adjustable opening size allowing anywhere from one to any discrete or random number of cards or brochures to be dispensed as the lever is drawn across the device from the right to the left. Generally the slot size would be set to accommodate one or at most two business cards, one for an individual to retain and one for that individual to write a note on and leave in the article storage area. As the lever is moved back to the initial, right-most position, the cards would be retained in place by a retaining wall 94. The device could be constructed such that the slider and friction surface are in a fixed plane, along with the upper cross member, however, the slider assembly might also be constructed such that it is freely floating on the pusher element so that the slider and friction surface were able to tilt to match the angle of the stack of cards. In this manner, the slider and friction surface are able to move freely back and forth between the cards and the lower surface of the upper cross member.

These views also show the top portion in a slightly angled orientation with curved ends. These features permits rain water, snow or other debris from accumulating and will direct the water to the side, drained clear from the device.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true spirit and scope of the invention.

We claim:

1. An integrated business card and information dispenser for storing a stack of flat articles such as business cards, promotional literature or real estate information, for dispensing the articles, and for securely receiving deposits and deliveries, the integrated business card and information dispenser device comprising:

a housing, the housing having a top portion, a front face and a plurality of side portions, one of the side portions having a dispensing slot extending horizontally across the portion, the dispensing slot having an aperture of a predetermined dimension such that a predetermined number of articles are dispensed from the device;

a lower internal article storage section accessible via a deposit window, the deposit window allowing articles to be deposited into the lower section;

a central cross member;

an upper article storage and dispensing section, the upper section being divided from the lower section by the central cross member, the upper section having:

a floating platform for supporting the articles to be dispensed from the lower side;

a biasing means, the biasing means urging the floating platform upward, the biasing means disposed between the central cross member and the floating platform;

an upper cross member, the biasing means urging the stack of articles to be dispensed against the upper cross member;

a slider with a lower friction surface, the slider disposed between the upper cross member and the stack of articles to be dispensed; and a dispensing lever, the lever extending through the front face of the housing for manual or mechanical operation, the lever connected to the slider by a linking element and a pusher element, the position of the lever determining the lateral position of the slider, whereby as the lever is operated so as to effect a transverse motion of the slider such that the friction surface of the slider acts upon the uppermost article of the stack of articles to be dispensed, that particular article is moved outward from the upper article storage and dispensing section through the dispensing slot.

2. The invention of claim 1 wherein the housing bears a plurality of identifying and informational indicia.

3. The invention of claim 1 wherein the top section is sloped to one side so as to prevent accumulation of rain, snow or other debris on the front face and to drain water away from the dispensing slot.

4. The invention of claim 1 wherein the device is weatherproof.

5. The invention of claim 1 wherein the biasing means is a spring.

6. The invention of claim 1 wherein the device further comprises a mounting means.

7. The invention of claim 6 wherein the mounting means is one selected from the group consisting of nails, bolts, screws, magnets, fibers, wires, straps, clamps, adhesives and adhesive-backed materials.

8. The invention of claim 1 wherein the front face is secured to the casing of the device with a security lock.

9. The invention of claim 1 further comprising a marking device.

* * * * *